United States Patent [19]

Epstein et al.

[11] Patent Number: 5,053,752

[45] Date of Patent: Oct. 1, 1991

[54] SMOKE DETECTOR AND METHOD USING ELONGATED FLEXIBLE LOW BATTERY CONDITION INDICATOR MEMBER

[75] Inventors: Jack Epstein, 155 E. 31 St., Apt. 28J, New York, N.Y. 10016; Morris Epstein; Jay Monroe, both of Kings Point, all of N.Y.

[73] Assignee: Jack Epstein, New York, N.Y.

[21] Appl. No.: 485,169

[22] Filed: Feb. 26, 1990

[51] Int. Cl.[5] ..... G08B 17/10

[52] U.S. Cl. ..... 340/628; 340/815.29; 340/691; 340/636; 340/815.26; 116/278; 116/DIG. 14

[58] Field of Search ..... 340/628, 693, 691, 636, 340/815.24, 815.26, 811, 815.29; 116/5, 214, 204, DIG. 14, DIG. 33, 67 A, 278

[56] References Cited

U.S. PATENT DOCUMENTS

| | | | |
|---|---|---|---|
| 482,263 | 9/1892 | Moore | 340/815.29 |
| 749,105 | 1/1904 | Scott | 340/815.29 |
| 1,309,286 | 7/1919 | Hopkins | 340/815.29 |
| 1,612,504 | 12/1926 | Furman | 340/815.29 |
| 2,518,979 | 8/1950 | Davidson | 340/815.29 |
| 3,959,787 | 5/1976 | Messmann et al. | 340/691 |
| 3,987,426 | 10/1976 | Jansen | 340/691 |
| 4,030,086 | 6/1977 | Salem | 340/636 |
| 4,223,305 | 9/1980 | Arima | 340/628 |
| 4,228,428 | 10/1980 | Wiedermeyer | 340/628 |
| 4,487,308 | 12/1984 | Logan, Jr. et al. | 340/628 |
| 4,514,725 | 4/1985 | Bristley | 340/691 |
| 4,535,325 | 8/1985 | Marsh | 340/636 |
| 4,642,605 | 2/1987 | Karp | 40/610 |
| 4,808,977 | 2/1989 | Hedrick | 340/691 |
| 4,881,063 | 11/1989 | Fawcett | 340/691 |
| 4,975,688 | 12/1990 | Gonzales | 340/628 |

*Primary Examiner*—Donnie L. Crosland
*Assistant Examiner*—Jill Jackson
*Attorney, Agent, or Firm*—Gregor N. Neff

[57] ABSTRACT

The low battery level indicator is provided for a smoke detector. When the battery in the smoke detector becomes so weak that its voltage drops below a pre-determined value, an elongated, flexible signal member such as a tape or cord is released from the smoke detector so that it hangs down into the room below to persistently remind the occupant to replace the battery with a fresh one. The elongated signal member can be used together with a conventioanl device which emits audible periodic beeps or has a periodically flashing light to indicate the low battery condition. However, the long flexible signal member continues to hang down and remind the occupant that the battery must be replaced, even after the battery has gone completely dead and the horn and lamp no longer function. This invention constitutes a potential life-saving device.

23 Claims, 7 Drawing Sheets

FIG. 3
2/4
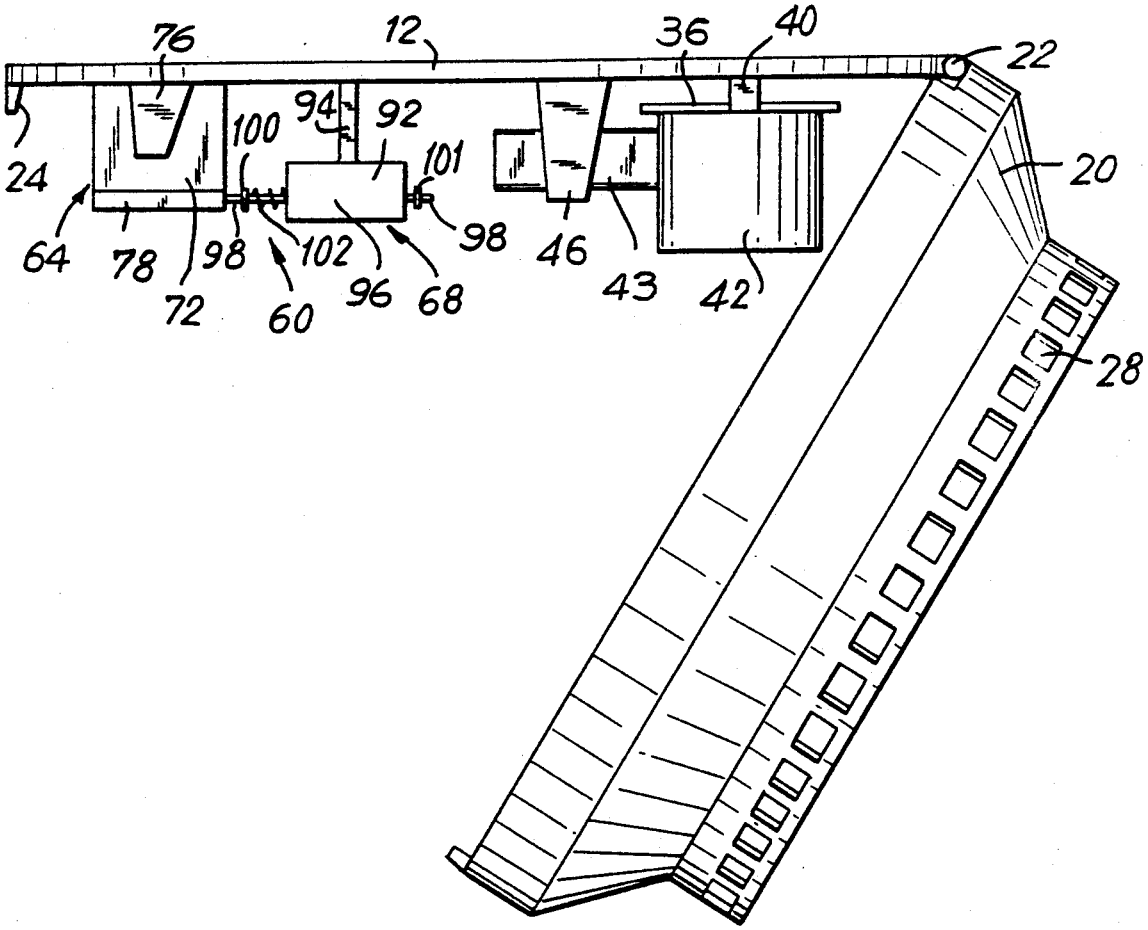
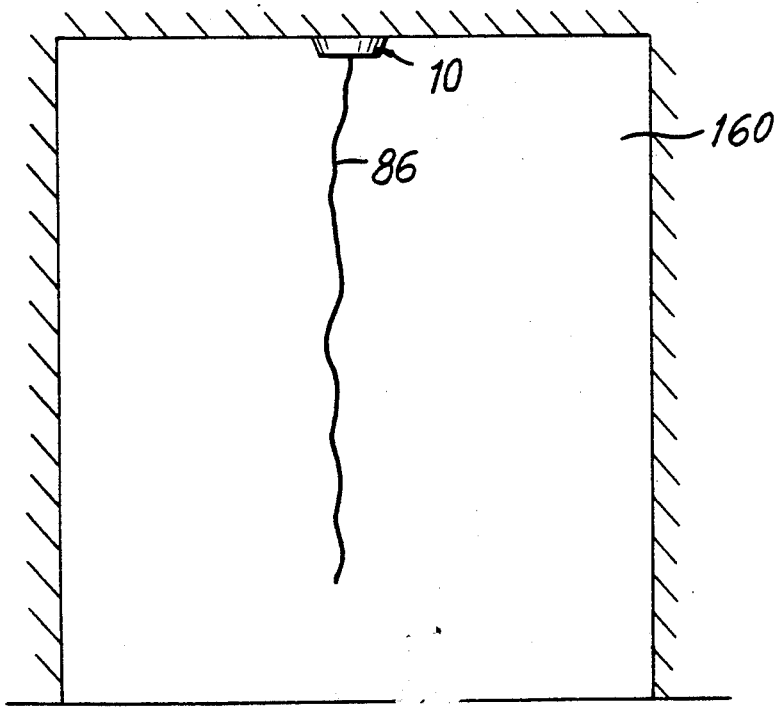
FIG. 8

SMOKE DETECTOR AND METHOD USING ELONGATED FLEXIBLE LOW BATTERY CONDITION INDICATOR MEMBER

This invention relates to a low battery condition warning indicator apparatus and method for self-contained use with battery-operated devices such as smoke detectors.

Low battery condition warning indicators for battery-operated devices such as smoke detectors are well known in the prior art.

For example, battery-operated smoke detectors manufactured and marketed by Family Gard Inc., Box 68, Aurora, Ill. 60507-0068, under the Registered Trademark "FAMILY GARD" as catalog number FG 888D, include a low battery condition warning indicator in form of intermittent actuation at one minute intervals of the smoke detector horn to provide what is described by the manufacturer as a "low battery 'beep' signal" which sounds once a minute to warn of a low battery condition.

One of the problems with such devices is that this "beep" may very well not be heard in all instances by the aged or infirm, in particular, the hearing-impaired. Even those with full faculties who do hear the "beep" tend to ignore it, or simply "learn to live with it," rather than go to the trouble of changing the battery.

Another problem is that the "beep" signals will be generated during an extended absence of the occupants of the building in question for vacation, family emergency, or the like, so that there simply will not be anyone present to hear the warning signals. Since the intermittent "beep" can only continue for as long as there is sufficient electrical energy remaining in the smoke detector battery, it will be immediately clear to those skilled in this art that the extremely dangerous situation will ultimately be reached wherein the electrical energy falls below that minimum level required to generate the low battery condition warning "beep," much less the substantially higher minimum energy level required to continuously actuate the alarm horn to warn of a fire, without any discernible warning of any nature being provided to the building occupants that the smoke detector has, in fact, become totally useless with regard to fire detection and warning; all, of course, with potentially fatal results.

Most conventional smoke detectors, such as such as that described above, have a test button which, when pushed, activates the detector alarm horn after a set time delay to confirm that the detector is operating properly, and are packaged with specific instructions to "TEST DETECTOR WEEKLY". However, such instructions often are not followed, especially where the smoke detector is mounted on the wall or ceiling well above floor level, and testing by pushing the test button requires the inconvenient use of a step-ladder or the like to reach the detector. Thus, the provision of this test button and test instruction does not insure prompt and consistent discovery and replacement of low or "dead" smoke detector batteries.

Another prior smoke detector, the GE Model 8201-101 made by General Electric Corporation, emits a low-frequency repetitive "beep" signal to indicate that the battery is low, and also has a plastic flag which is located inside the detector housing whenever a battery is in the proper location. The flag is visible inside of the housing whenever the cover is removed, and bears a message advising the owner to replace the battery whenever the beeping noises is heard, or the alarm does not sound when the test button is pushed.

When the battery is removed, the flag pops out of an opening in the side of the housing, and is parallel to the surface on which the smoke detector is mounted. The flag thus advises anyone who sees it to replace the battery. The flag is pushed back into the housing when the battery is replaced.

The flag of the G.E. smoke detector does not indicate when the battery is low and needs replaced with a new one; rather, that function is performed by the "beep" signaling device, as in the other smoke detectors described above. Moreover, the flag is easy to ignore, since it usually is close to the ceiling or wall of the room. In short, the GE device does not protect against the failure to detect the low or exhausted battery condition after the battery is too weak to beep any longer, and does nothing to help hearing-impaired people detect that dangerous condition.

Other devices have been proposed for indicating the absence or exhaustion of a battery under certain circumstances. However, these other devices either do not indicate the need to replace a battery whenever its energy is low and/or do not indicate the condition unambiguously, and thus can be dangerous to the safety of the users, and/or do not signal the condition in a way which strongly encourages the user to replace the battery promptly.

It is, accordingly, an object of this invention to provide a new and improved apparatus and method for warning of a low battery condition in devices, such as smoke detectors, which are powered by one or more batteries, and which eliminate or alleviate the problems set forth above.

It is another object of this invention to provide such apparatus and method which give a visible low battery condition warning which is so prominent that it is extremely difficult or virtually impossible to ignore.

It is another object of this invention to provide such apparatus and method wherein the low battery condition warning is given even after the battery in question has gone completely "dead," and any audible signal has disappeared.

It is another object of this invention to provide such apparatus as above which may be readily and conveniently self-contained in the battery-operated device without significant modification of its structural configuration or manner of operation.

It is another object of this invention to provide apparatus and method as above wherein the low battery condition warning indicator, once properly activated, is essentially fail-safe in operation, and thus is highly dependable.

It is another object of this invention to provide such an apparatus and method which are relatively simple in construction, and are relatively inexpensive to build and use.

In accordance with the present invention, the foregoing objects are met by the provision of a low battery level indicating device and method, and particularly a smoke detector device and method utilizing the device and method, in which a visible signal is produced to indicate that the battery is low and must be changed. The signal is so prominent and persistent that it is very difficult to ignore, thus strongly encouraging the prompt replacement of the battery.

In a preferred embodiment, the smoke detector includes a visible signal device mounted in the same housing with the smoke detector and other elements and can be attached high up on a wall or, preferably, on the ceiling of a room in a building. When the battery energy level drops below a pre-determined level, a visible signal member, in the form of an elongated flexible tape or string, pops out of the smoke detector housing and hangs down into the room. Preferably, it hangs to a level at least as low as eye-level, and remains there until the battery is changed and the tape or string is returned to the housing or replaced.

The eye-level presence of the flexible signal reminds the occupant frequently of the need to change the battery. Moreover, even after the battery strength has dropped too low to create the low-battery beeping noise or flashing light, the visible signal continues to tell the occupant to change the battery. Thus, if the low battery level causes the beep signals to occur when the building is unoccupied for a long time, as when the occupants are away on vacation, for example, the returning occupants will see the tape hanging down and know that the smoke detector is inoperative and needs a new battery, even though the smoke detector is silent.

The signal strip or tape serves as a constant reminder to change the battery, and yet it is soft and light-weight and thus not harmful to people coming in contact with it.

The string or tape, easily can be replaced and restored in the smoke detector housing when changing the battery.

In one embodiment, the tape can be re-wound on a reel when it is being returned to the housing. Alternatively, the tape can be stored in random form in a compartment. Alternatively, the tape can be resilient and permanently creased, and easily folded into a compartment like the bellows of an accordion.

If the tape is re-wound on a reel, the re-winding can be done by a thumb-wheel, a spring, or a motor.

A cartridge containing a new tape can be used to easily replace the tape. A battery-holder and battery can be packaged together to facilitate replacing both battery and tape at the same time.

The invention is useful in various different types of smoke detector housings, including those which swing down from the ceiling to give access to the interior to replace the battery, as well as those which are easily dismounted from the ceiling or walls to replace the battery in a compartment accessible from the outside.

In another embodiment of the invention, the indicator tape or string cannot be re-stored in the smoke detector housing until a new battery is installed. Circuitry is provided to discourage the user from returning the tape to the housing without first installing a new battery.

The above and other objects and advantages of the invention are described in or apparent from the following detailed description, taken in conjunction with the accompanying drawings, wherein;

FIG. 3 is a side elevation view of the smoke detector of FIG. 1 with the cover open;

FIG. 8 is a side elevation view of a room in a building showing the highly prominent nature of the low battery condition warning indicator of the invention as used in to a ceiling-mounted smoke detector;

Figure 1:
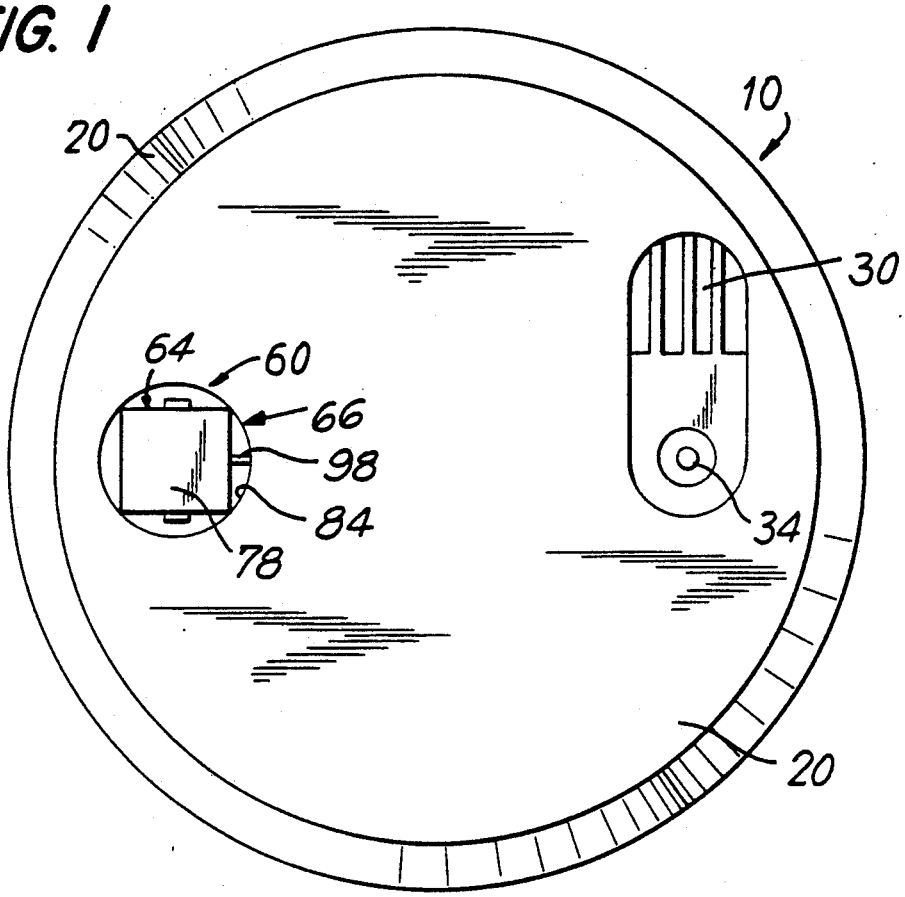
FIG. 1 is a bottom plan view of a battery-operated smoke detector incorporating highly prominent, a low battery condition warning indicator representatively configured and operable in accordance with the currently contemplated best mode of this invention.
Figure 2:
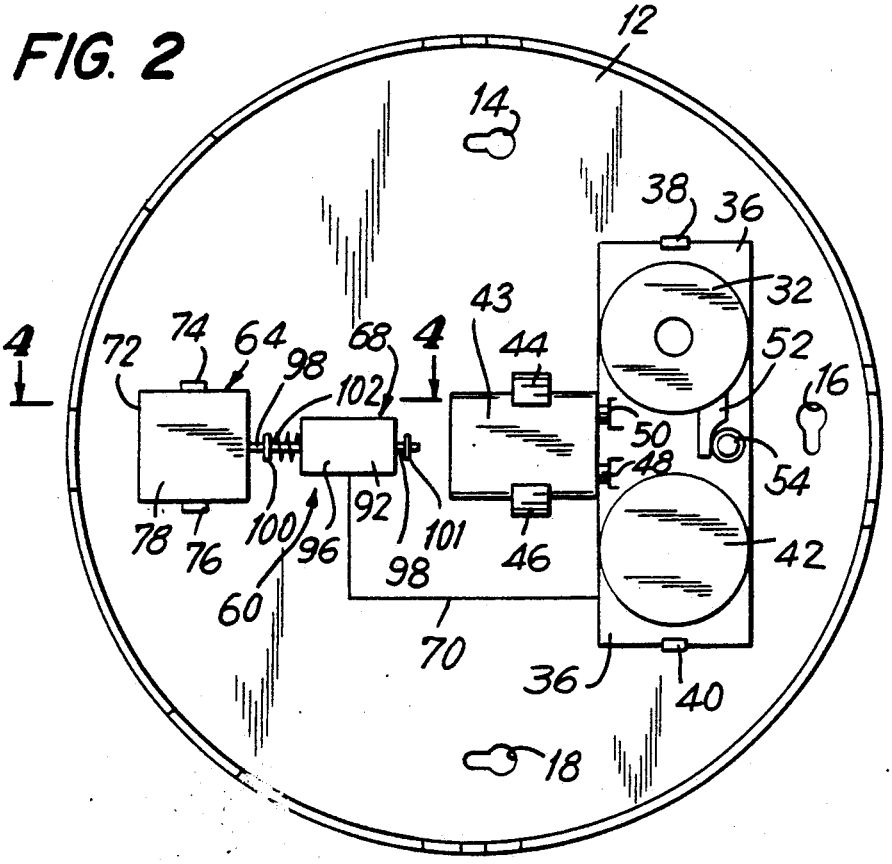
FIG. 2 is a bottom plan view of the smoke detector of FIG. 1 with the cover removed to clearly illustrate the working components of the smoke detector, and of the low battery condition warning indicator of the invention.

FIGS. 1, 2 and 3 of the application drawings show a smoke detector 10 constructed in accordance with the invention.

Referring to FIG. 2, which is a bottom plan view, the detector 10 includes a circular base member 12 having spaced mounting slots or the like 14, 16 and 18 formed therein for the wall or ceiling mounting of the smoke detector through the use of conventional mounting screws. A circular detector cover is indicated at 20, and is of somewhat greater diameter than the base member 12.

As it is shown in FIG. 3, member 20 is pivotally mounted on the base member 12 by hinge means, and is movable from the open position of FIG. 3 to expose the working elements of the smoke detector 10, to the closed-cover position of FIG. 1 wherein the cover member overlies the base member and those working elements. Retaining clip means are indicated at 24 and 26 in FIG. 3, and are respectively provided on the base and cover members 12 and 20 to retain the latter in the closed position. An array of closely spaced apertures is indicated at 28 in FIG. 3, and is formed as shown to extend around the periphery of the cover member 20 to admit ambient air to the smoke detector 10 with the cover closed. Referring again to FIG. 1, a ribbed aperture 30 is formed in the bottom surface of the cover 20 to overlie the detector alarm horn 32 (FIG. 2) with the cover member closed to enhance sound transmission from the smoke detector 10 when the alarm horn is sounded. A transparent detector test button is indicated at 34 in FIG. 1, and is operable when depressed as discussed hereinabove to sound the alarm horn 32 to indicate that the smoke detector 10 is operable.

As best seen in FIG. 2, the working elements of the smoke detector 10 comprise a detector operating circuit board 36, which is supported as shown from the detector base member 12 by a plurality of spaced mounting clips or the like, two of which are indicated at 38 and 40, respectively, in FIG. 2. The detector alarm horn 32, and an ionization smoke sensing chamber as indicated at 42, are supported in turn from the circuit board 36 in any appropriate manner and, of course, electrically connected thereto.

Referring now to FIG. 3, as well as FIG. 2, a conventional 9-volt dry cell battery 43 is supported in readily-removable manner on the detector base member 12 by opposed spring clips 44 and 46, and electrically connected to the operating board 36 by connectors 48 and 50 (FIG. 2) to provide operating power for the smoke detector 10.

As is best seen in FIG. 2, an actuator arm 52 extends from the detector alarm horn 32 to underlie a side portion of the cover-mounted test button 34 (FIG. 1) for activation as described of the alarm horn, assuming all detector components to be working properly, when the test button is depressed; while an indicator light 54 is mounted on the circuit board 36 to underlie the central portion of the transparent test button 34 so as to visible therethrough with the cover member 20 closed, and is briefly energized periodically, for example once a minute, to indicate that the smoke detector 10 is operating properly.

In operation, upon detection by sensing chamber 42 of a sufficient level of smoke or combustion by-products in the ambient air to indicate the presence of a fire or incipient fire, the alarm horn 32 will be energized through operating circuit 36 to emit a persistent, particularly loud and piercing wail, as opposed to the intermittent "beep" discussed hereinabove, to warn of the fire. Thus, the basic configuration and manner of operation of the smoke detector 10 described so far will be readily understood by those skilled in this art to be essentially conventional; all as illustrated and described for example in somewhat greater detail in the User's Manual, MO-497-00, of July 1987 which accompanies the "FAMILY GARD" Smoke Detector as described hereinabove, and the disclosure of which is hereby incorporated by reference in this specification.

A new and improved, highly prominent, low battery condition warning indicator device representatively configured and operable in accordance with the teachings of the currently contemplated best mode of the apparatus and method of this invention is indicated generally at 60 in FIGS. 1 through 5 of the drawings.

Figure 4:
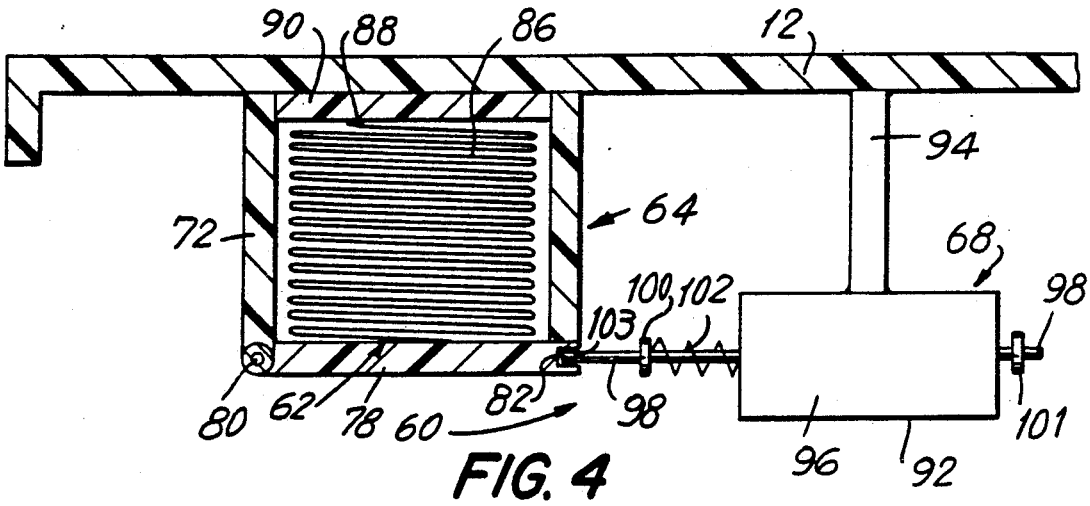
FIG. 4 is an enlarged cross-sectional view taken essentially along line 4—4 in FIG. 2, and illustrates the low battery condition warning indicator of the invention in the unactuated condition thereof.
Figure 5:
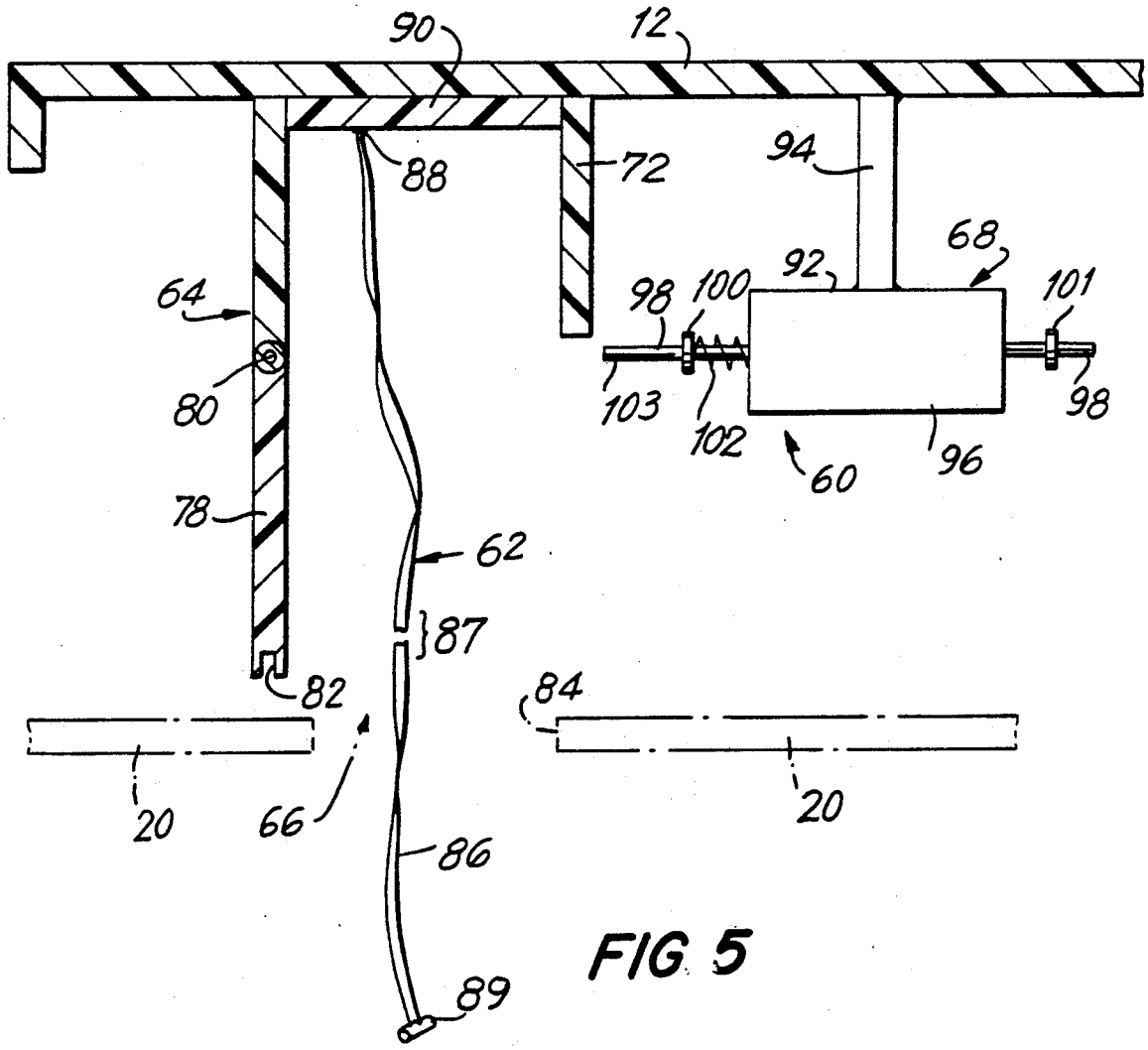
FIG. 5 is an enlarged cross-sectional view also taken essentially along line 4—4 in FIG. 2 depicting the low battery condition warning indicator of the invention in the actuated condition thereof, and includes the depiction in phantom of the relevant portion of the smoke detector cover.

Referring particularly to FIGS. 4 and 5, the device 60 includes a warning indicator 62, warning indicator housing means 64, warning indicator access means 66 (FIGS. 1 and 5) which are formed in the cover member 20 to be aligned with the housing 64 when the cover is closed, and electromechanically-operable warning indicator actuating means as indicated generally at 68 (FIGS. 2–5). Further included in the warning indicator device 60, as described in greater detail hereinbelow, is a warning indicator means operating circuit (FIG. 6 or 7) which is located on the smoke detector operating circuit board 36. The line 70 in FIG. 2 indicates that the warning indicator operating means 68 is electrically connected to that operating circuit board.

As best seen in FIGS. 2, 4 and 5, the warning indicator support means 64 comprise a box-like container which is supported as shown from the smoke detector base member 12 by spring clips or the like 74 and 76. The lower wall 78 of container 72 is hinged as indicated at 80 in FIGS. 4 and 5 so as to be pivotable from the closed position of FIGS. 2, 3 and 4 to the open position of FIG. 5. Container wall 78 further includes a latching aperture 82 formed as shown in the edge thereof opposite hinge 80 as seen in FIGS. 4 and 5. The warning indicator access means 66 are formed by an opening 84 in the smoke detector cover 20 which underlies and is in vertical alignment with the container wall 78 when the smoke detector cover 20 and wall 78 are in the closed positions, as seen in FIG. 4.

As best seen in FIGS. 4 and 5, the warning indicator 62 preferably is an elongated, relatively thin strip 86 of flexible relatively soft material, for example cloth or plastic, which may be easily rolled or folded or wadded up for ready and convenient storage in the container 64 with lower container wall 78 closed. The upper end of the strip is attached as indicated at 88 in any convenient manner to the upper wall 90 of the container 72, while a small weight 89 is attached to the lower end of the strip. Thus, when the cover 78 of the container opens, the strip 62 falls out of the smoke detector through the opening 84 in the smoke detector cover 20, and hangs downwardly therefrom, as shown in FIG. 5.

The warning indicator actuating means 68 comprise a solenoid or like electrochemical device 92 which is supported as shown by a support bracket 94 from the smoke detector base member 12 in position essentially adjacent the warning indicator container 72. The solenoid 92 comprises windings as indicated at 96, and an armature 98 extending therethrough as shown in alignment with the complementally sized latching aperture 82 in the lower container wall 78 when the same is in the closed position. Stops are indicated at 100 and 101 on the solenoid armature 98; and a coil spring 102 is disposed as shown around the armature 98 between the stop 100 and the solenoid windings 96 to bias the armature 98 to the left to its extended position, as seen in FIGS. 3 and 4, wherein the left end portion 103 (See FIGS. 4 and 5) of the armature will be disposed within the latching aperture 82 of the lower container wall 78 to retain the same in the closed position against the force of gravity.

With the solenoid windings 96 energized through the warning indicator operating circuit to be described in detail hereinbelow, the armature 98 will be moved to the right to the retracted position shown in FIG. 5 to withdraw the armature end portion 103 from the latching aperture 82, thus enabling the lower container wall to pivot to the open position under the force of gravity, with the resultant fall of the free end of the indicator strip 86 from the container 72 through opening 84 to the position shown in FIG. 5.

The indicator strip 62 is broken at 87 to indicate that it actually is considerably longer than it seems to be in FIG. 5.

Figure 6:
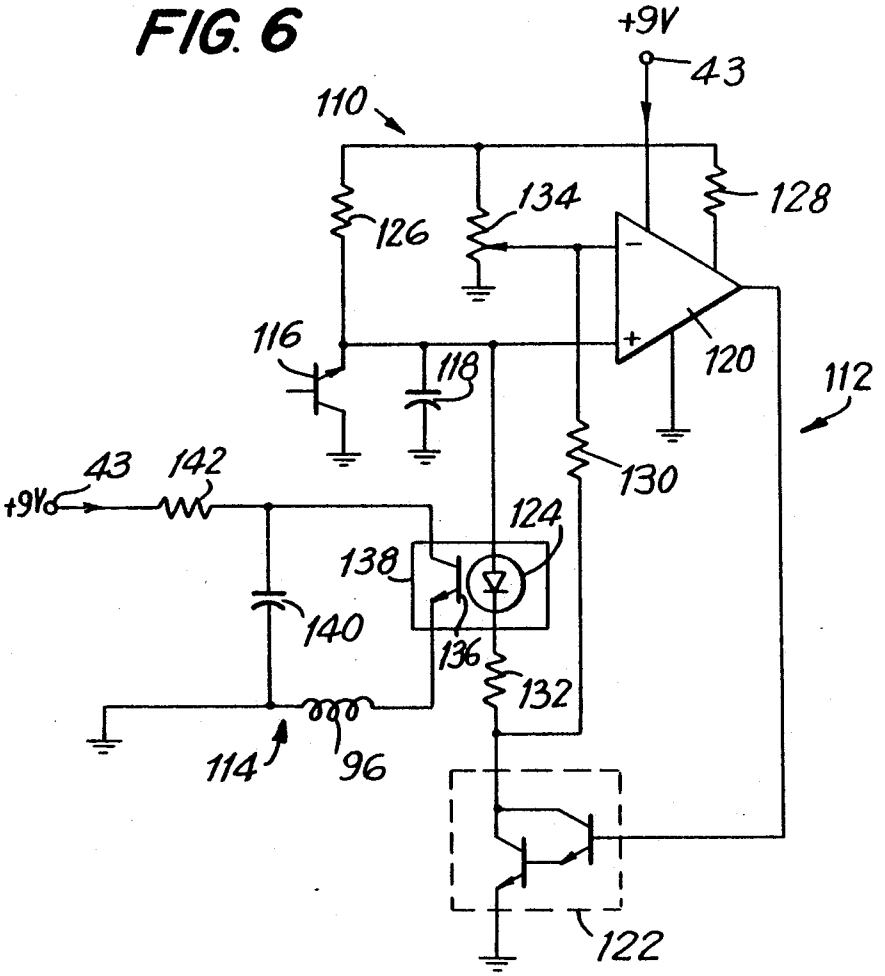
FIG. 6 is a schematic diagram of a first operating circuit for the low battery condition warning indicator of the invention.

A first operating circuit for the low battery condition warning indicator of the invention is indicated generally at 110 in FIG. 6.

The circuit 110 includes a low battery indicating portion 112, and a warning indicator circuit portion 114, which is optically coupled to the portion 112. Circuit portion 112 takes the form illustrated and described at page 124 of the *Encyclopedia of Electronic Circuits*, as identified hereinabove, and the disclosure of which is hereby incorporated by reference in this specification. Circuit 112 comprises a transistor 116, a capacitor 118, an amplifier 120, a Darlington circuit 122, a LED 124, resistors 126, 128, 130 and 132, and trip adjustment resistor 134 interconnected as shown to detect the voltage from the 9 volt battery connected as indicated at terminal 43.

In operation, circuit 112 is operable to flash the LED 124 when the voltage output from 9 volt battery 43 drops below a pre-set level, for example 6 volts, at which the battery is nearing exhaustion and should be replaced. As this occurs, and with transistor 116 functioning as a zener diode to establish about 6 volts on the positive input of the amplifier 120, the output of the latter goes high, thereby turning on the Darlington Circuit to discharge capacitor 118 through the LED 124 to flash the latter, for example at two second intervals, and thus provide a visible warning that the battery is low and should be replaced.

Actuating circuit 114 comprises a opto-bipolar transistor 136 optically coupled as shown to LED 124 to form an optocoupled switch. Shielding is indicated at 138 and surrounds the LED 124 and transistor 136 to prevent ambient light from impinging on the latter. An electrolytic capacitor is indicated at 140, with the charge thereon being maintained through a charging resistor 142 from the connected terminal of the 9 volt battery 43. The windings 96 of the solenoid 92 of FIGS. 2 through 5 are connected as shown in series with the charging resistor 142 and the transistor 136 across the battery 43.

As the voltage in the battery 43 falls below 6 volts, LED 124 will be flashed, thereby saturating opto-bipolar transistor 136 and causing it to conduct with a low impedance. This allows the charge stored in capacitor 140 to be discharged into the solenoid windings 96. This energizes the solenoid 92, with the result that the solenoid armature 98 is moved from the extended position of FIG. 4 to the retracted position of FIG. 5, thereby removing armature end portion 103 from container wall latching aperture 82, allowing lower container wall 78 to pivot under the force of gravity to the open position, and allowing the weighted free end 86 of the indicator strip to fall under the force of gravity through cover member opening 84 to extend downwardly from the smoke detector 10 to provide a highly prominent indication and warning of the low condition in smoke detector battery 43.

Figure 7:
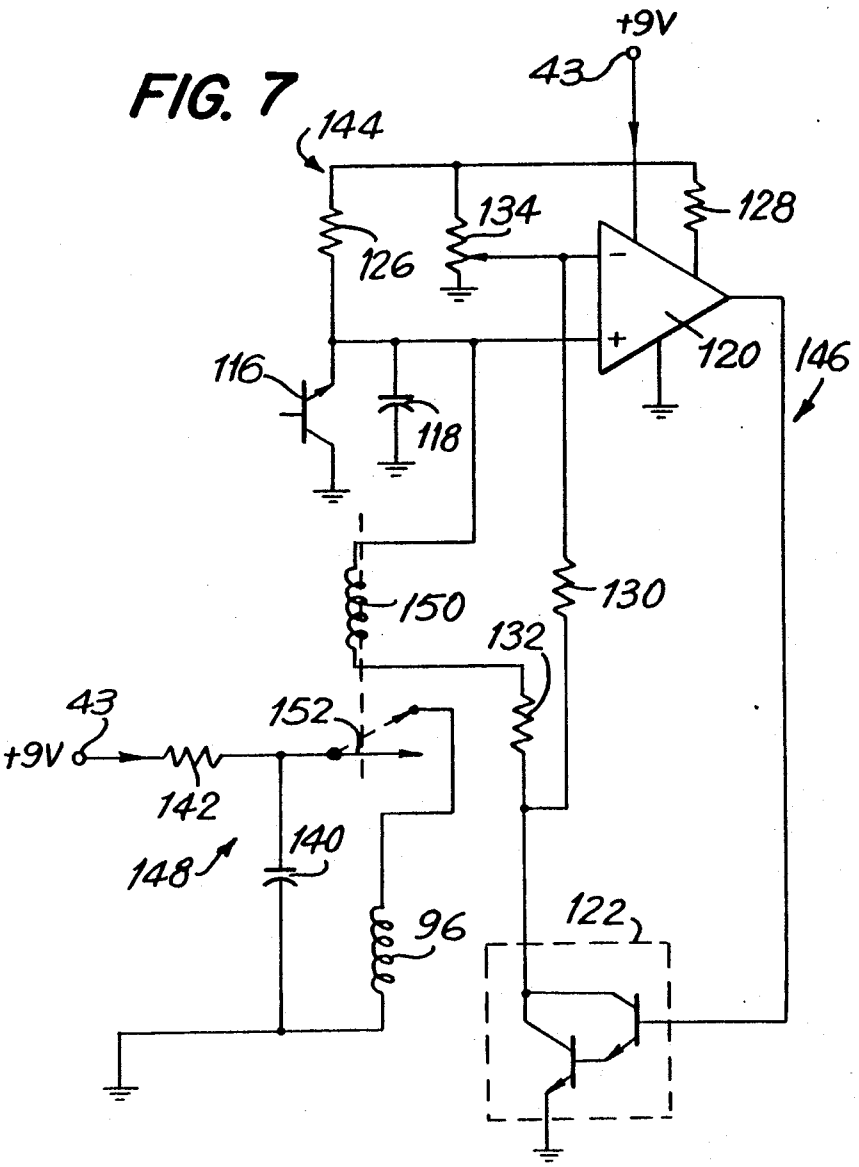
FIG. 7 is a schematic diagram of a second operating circuit for the low battery condition warning indicator of the invention.

A second representative operating circuit for the low battery condition warning indicator 60 of this invention is indicated generally at 144 in FIG. 7. The circuit 144 similar to that shown in FIG. 6, except that it does not have a flashing lamp to indicate a low battery condition.

The circuit 144 includes portions 146 and 148 which correspond, respectively, to circuit portions 112 and 114 of FIG. 6, with the exception of the substitution of the windings of a highly sensitive relay 150 in FIG. 7 for the LED 124 of FIG. 6, the circuit 146 of FIG. 7 is identical to the circuit 112 of FIG. 6. Similarly, with the exception of the substitution of the contact arm 152 of the relay 150 the opto-bipolar transistor 136 of FIG. 6 actuating circuit 148 of FIG. 7 is identical to actuating circuit 114 of FIG. 6.

Preferably, the relay 150 also operates the horn (not shown in FIG. 7) of the smoke detector intermittently so as to produce an intermittent "beep" alarm to audibly indicate the low battery condition, until the battery goes completely dead.

Thus, the occupant of the building has two low battery warning devices, until the battery goes dead. Because of the invention, one warning device, the strip 86 hanging down into the room, staunchly remains to tell the occupant that the battery needs to be replaced.

In fact, under these circumstances, the invention serves an even more vital function—that of telling the occupant that the smoke detector is totally inoperative because the battery is totally dead. This is something that an occupant returning after a long absence might not know otherwise because the audible beeping would have stopped before he or she returned, and the occupant easily might forget to check the unit with the test button.

If preferred, the beeping of the horn to indicate a low battery can be eliminated so that the signal strip 86 is the sole indicator of the need for a new battery. This can be beneficial to those who might be misled into thinking that the beeping noise indicates the detection of a fire. Elimination of the beeping can make the battery last longer, since after it drops down, the signal strip 86 continues to hang down without the use of further electrical energy. Therefore, the creation of an intermittent electrical signal to drive the LED 124 of FIG. 6 or the relay 130 of FIG. 7 is not necessary.

Preferably, the solenoid 92 is a latching solenoid which latches with the armature 98 in the retracted position shown in FIG. 5, and will not return the armature to the extended position shown in FIG. 4 until a new battery is installed. This will prevent the occupant from simply replacing the signal strip 62 in the housing 64 without changing the battery, thus removing the reminder to get a new battery. The application of the full 9 volts of a new battery unlatches the solenoid to permit the housing 64 to be closed again because the end 103 of armature 98 again is in a position to be inserted into the groove 82 in the cover 78.

The pulsating electrical signal supplied to the LED 124 or the relay 150 might cause the solenoid armature to move back and forth while the LED is flashing or the horn is beeping. This can be prevented by using a latching solenoid, as noted above, and/or by making the time-constant of the circuit for charging the capacitor 140 very large so that the capacitor 140 will not charge up to a voltage large enough to operate the solenoid in the time intervals between "beeps" or LED flashes.

The preferred form of the low battery condition signal strip 86 of FIGS. 4 and 5 is a strip of approximately ½ inch in width and 6 feet in length formed form a very thin, flexible plastic material in the nature of Mylar to enable the ready and convenient containment of the strip in the box-like container 64. The softness, flexibility and light weight of the strip avoid injury to persons coming into contact with the strip. Visibility of the strip 86 is readily enhanced by coloring it with a particularly conspicuous and readily visible color, for example blaze fluorescent orange or yellow, and/or printing on it a warning legend, for example: "SAFETY WARNING, BATTERY NOW TOO LOW TO OPERATE DE- TECTOR, CHANGE BATTERY NOW FOR YOUR OWN PROTECTION". The legend can be printed repeatedly along the length of the strip 86 and on both sides in a contrasting color to make the legend almost impossible to ignore.

A representative application of the smoke detector 10 incorporating the low battery condition warning indicator 60 of the invention is illustrated by FIG. 8 of the drawings. More specifically, with the smoke detector 10 ceiling mounted, as it now is almost universally recommended by the leading smoke detector manufacturers, and with the low battery condition warning indicator strip 86 deployed as illustrated to indicate a low smoke detector battery condition, it will be immediately clear to those skilled in this art that the low battery condition warning indication provided by the apparatus and method of this invention is indeed highly prominent and, in fact, so highly prominent so as to render the same virtually impossible to ignore.

More specifically, and assuming the enclosure 160 within which the smoke detector 10 is ceiling mounted as illustrated in FIG. 8 to be a living room, bed room, or hallway of a dwelling, it becomes clear that continued utilization of that enclosure by the occupant(s) thereof, in accordance with the teaching of this invention, is interfered with to such an extent by the deployed indicator strip 86 that it becomes very difficult indeed for those enclosure occupant(s) to ignore and/or tolerate the presence of the strip; thus hopefully leading to the prompt replacement of the smoke detector battery 43, all to particularly significant safety advantage.

Preferably, the strip hangs down to within four feet from the floor, but it should hang down at least to the eye level of adults standing in the room. The length of the strip sold can vary so as to adapt it for use in rooms with ceilings of varying height. Alternatively, a single length, such as six feet, can be used. A signal strip 86, six feet long, will hand down to near the eye level of standing adults even in a room with twelve foot high ceilings, and will hang to within two feet of the floor in rooms with eight-foot high ceilings.

If the smoke detector is to be mounted on a wall of the room, rather than the ceiling then the container 64 for the strip 62 can be positioned to open toward one side wall of the smoke detector housing, and a hole like the hole 84 can be made in the side wall for the signal strip to fall through.

Replacement of the smoke detector battery 43 in response to deployment of the indicator strip 86 is accomplished in conventional manner by the opening of the smoke detector cover 20, the removal of the "low" battery 43 from connectors 48 and 50 and the retaining spring clips 44 and 46, and the insertion and connection of a fresh smoke detector battery there into, all in accordance with the smoke detector manufacturer's instructions.

Having accomplished this, the free end of the indicator strip 86 is simply withdrawn back through the opening 84 in the open cover member 20, the strip simply folded or rolled up, for example by rolling the same around the finger, and placed back in the container 64, solenoid armature 98 manually moved against the action of spring 102, by using a finger tip, to the retracted position thereof of FIG. 5 so that lower container wall 78 can be returned to the closed position thereof of FIG. 4, wall 78 returned to that position, and armature 98 released to return under the action of spring 102 to the extended position thereof of FIG. 4 with armature end portion 103 again entering latching aperture 82 in lower container wall 78 to again retain the indicator strip 86 within the container 64, thus returning the low battery condition warning indicator 60 of the invention to fully operational status. Smoke detector cover 20 is then simply re-closed.

Figure 9:
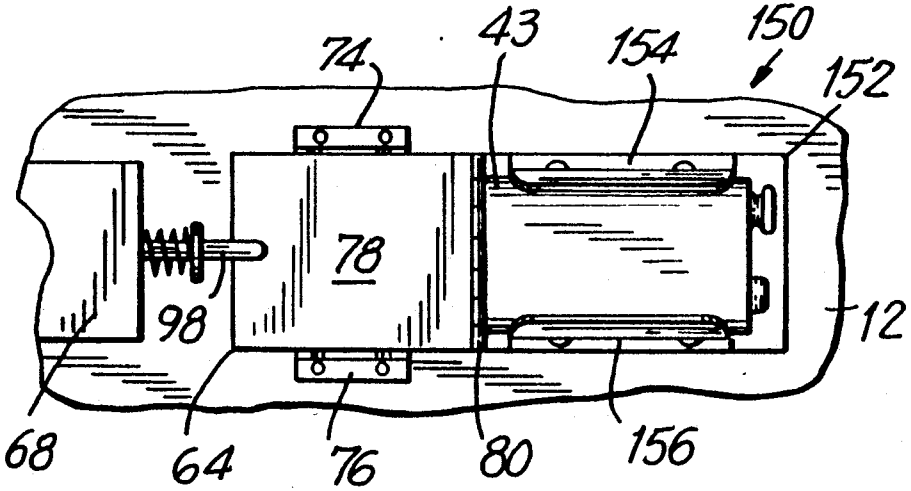
FIGS. 9 and 10 are bottom plan and side elevation views, respectively, of an indicator tape and battery cartridge for use in the invention.
Figure 10:
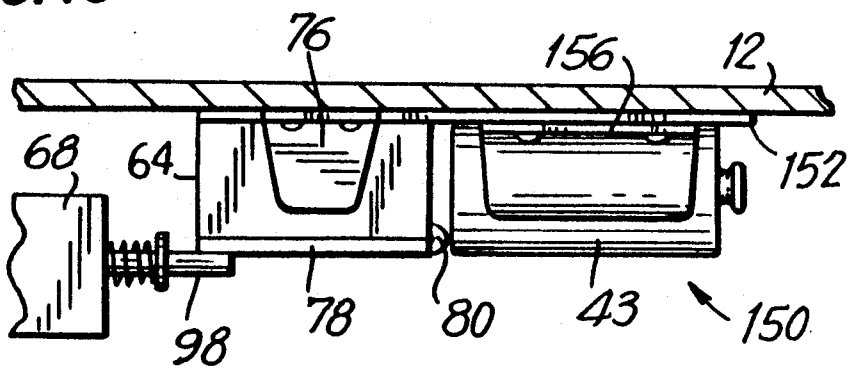

In the embodiment shown in FIGS. 9 and 10 of the drawings, the housing 64 shown in FIGS. 2 and 3 forms an easily replaceable cartridge which is used to facilitate replacement of the signal strip or tape 86 after it has been released. The tape and housing are relatively inexpensive and the replacement cartridges can be made at a reasonable cost. The spring clips 74 and 76 facilitate easy removal and replacement of the cartridge without tools.

Another cartridge 150 is shown in FIGS. 9 and 10. The cartridge 150 includes a support board 152. The housing 64 is mounted on the board 152, together with a pair of spring arms 154 and 156 to hold the battery 43. The battery holder and tape holder then become a single, replaceable cartridge which is snapped into place between the spring arms 74 and 76.

The cartridge 150 can be sold with a battery installed, or without. If the cartridge does not have a battery, the owner can purchase a battery separately and insert it into the cartridge when installing it in the smoke detector.

The battery 43 in the cartridge 150 either can be the only battery in the smoke detector, or it can be a spare battery in addition to the battery shown, for example, in FIG. 2. If the battery installed in the cartridge is a spare battery, it facilitates the immediate replacement of the worn-out battery without the user being required to go to the store and buy a fresh battery.

Figure 11:
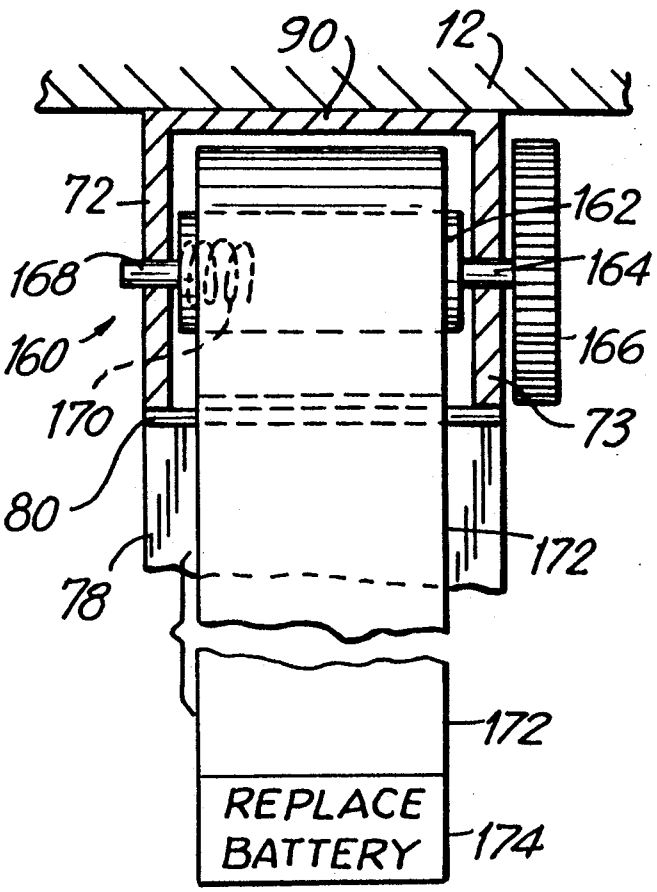
FIG. 11 is a partly cross-sectional, partly schematic and broken-away side elevation view of another embodiment of the tape storage and dispensing mechanism of the invention.

FIG. 11 is a partially cross-sectional and partially schematic view of a preferred embodiment of the signal tape storage and dispensing arrangement. A cylindrical plastic roll support 162 has projecting spindles 164 and 168 which extend through holes in the side wall 72 and 73 of the indicator tape storage and dispensing housing 160. A relatively large thumbwheel 166 is attached to the end of the spindle 164 outside of the housing. The hinged cover for the compartment is shown at 78 and is shown broken away for the sake of clarity in the drawings.

A length of indicator tape 172 is attached at its upper end to the roll 162 and wound up upon the roll for storage in the housing. An optional weight 174 is attached to the lower end of the tape 172, as in the previously described embodiment of the invention. An optional printed message "REPLACE BATTERY" is printed on the weight. The weight can be a solid plastic piece or an element made of similarly inexpensive material.

The hinged cover 78 swings down to open the housing 160 in the same manner as described above. When it opens, the tape 172 falls down and unwinds from the roll until the end of the tape is reached, at which point the tape stops. As in the previous embodiment, the length of the tape is set so that the lower end of the tape now is in the vicinity of eye level of an adult standing in the room in which the smoke detector is installed, or lower.

When the user replaces the battery of the smoke detector, it is a relatively simple matter to rewind the tape 172 on the roll by simply turning the thumb wheel 166 until the tape is completely wound and stored in the housing. Then the cover 78 can be moved to its upward position and locked in place with the solenoid arm 98 in proper position as shown in FIG. 4, where it is inserted into a notch in the lid, or, as in FIGS. 9 and 10, where it merely extends underneath the cover to hold it in place.

The unit !60 shown in FIG. 11 is relatively simple and inexpensive in construction, and makes it easy to rewind the signal tape when replacing the battery of the smoke detector.

A torsion spring 170 ca be used to assist the rewinding of the tape on the reel, in the manner of a window shade. If preferred, a small motor (not shown) can be used instead of the thumb wheel 166 to rewind the tape, after the battery has been replaced.

Figure 13:
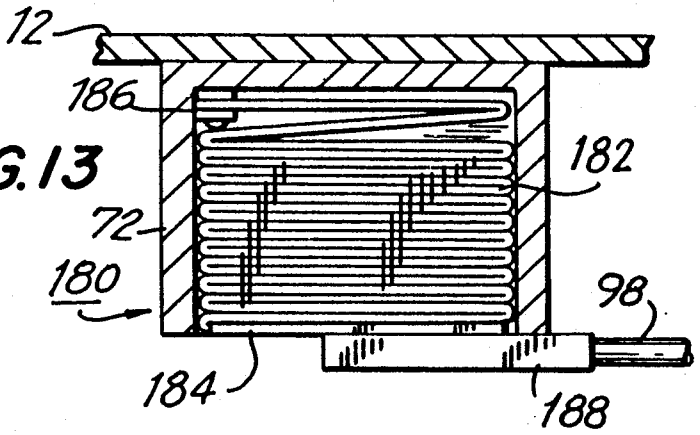
FIGS. 12 and 13 are views, similar to that of FIG. 11, of another tape storage and dispensing mechanism of the invention.
Figure 12:
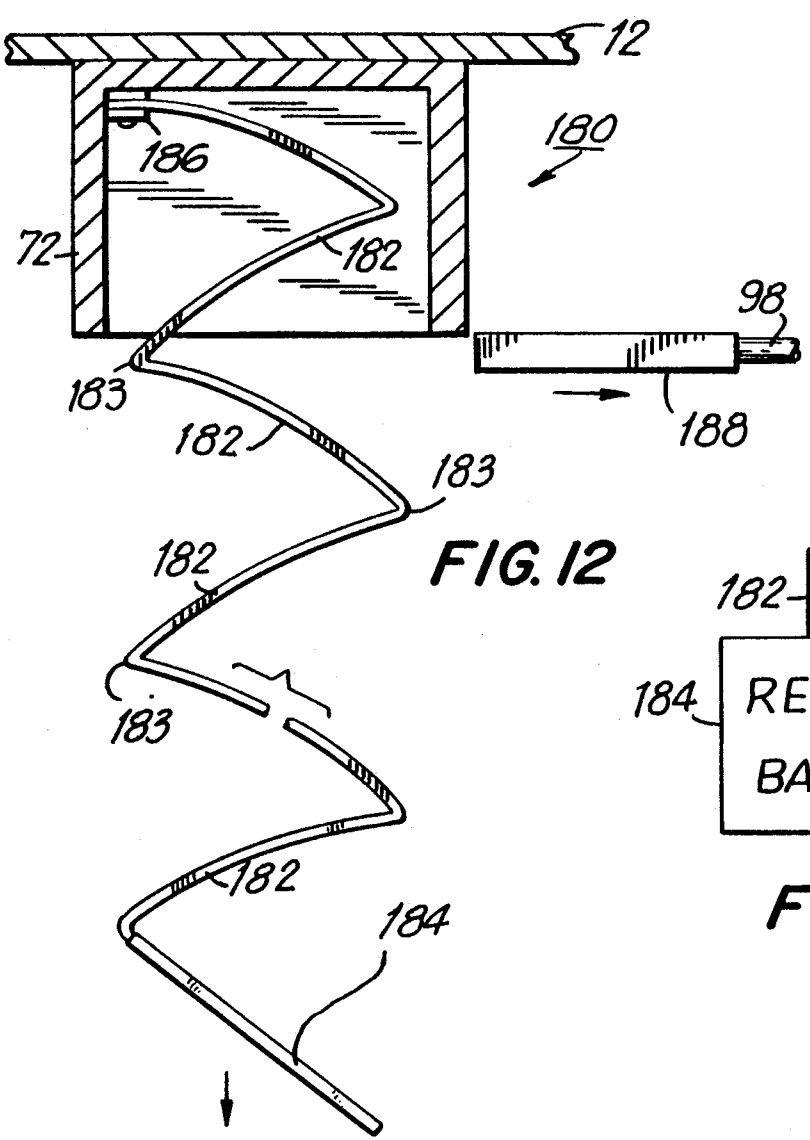

FIGS. 12 and 13 show an alternative form of the indicator tape or strip and its storage means. The unit 180 which stores the tape has a mounting fastener 186 secured to its upper wall. Attached to the mounting fastener 186 is one end of a relatively thin, flexible but relatively stiff plastic strip which has been pre-bent and permanently creased at the corners 183. The strip has a natural resilience tending to return it to its folded-up position as shown in FIG. 13, somewhat like accordion-folding bellows.

Attached at the lower end of the strip 182 is a closure member 184 which serves as a weight to pull the strip down and straighten it out, at least partially, in order to indicate the need for battery replacement.

Figure 15:
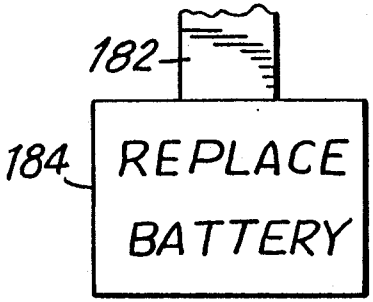
FIG. 15 is an elevation view of a portion of the device of FIGS. 12 and 13.

FIG. 15 shows a front elevation view of the member 184 which optionally contains the message "REPLACE BATTERY".

The plunger arm of the solenoid 98 is attached to a paddle-shaped closure member for the tape storage housing. The closure member or paddle 188 is shown in its retracted position in FIG. 12, and in its forward position in which it underlies the member 184 and supports the folded-up tape in the housing (the latter is shown in FIG. 13). Preferably, guides (not shown) are provided for guiding the paddle 188 in its forward and reverse motion.

In use, the device 180 shown in FIGS. 12 and 13 operates as the other embodiments, except that when it is time to replace the tape 182 in its housing, it is very easy to fold up because of the pre-creased corners and the resiliency of the tape, which urges it to fold up like the bellows of an accordion, thus making the folding job quick and easy. The elimination of a hinged lid for the compartment saves on construction cost and complexity.

Figure 14:
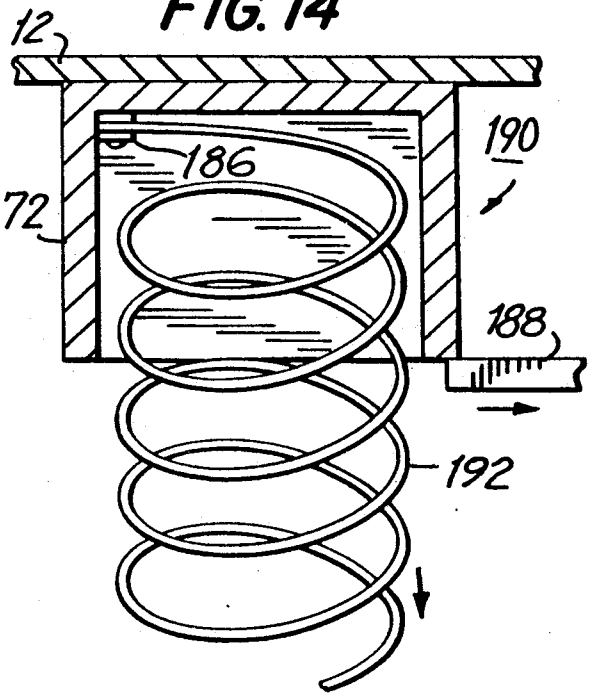
FIG. 14 is a view like FIGS. 11–13 of another embodiment of the tape storage and dispensing means of the invention.

FIG. 14 shows another embodiment of the tape supportive housing. This embodiment is substantially the same as that shown in FIGS. 12 and 13, except that a thin, very flexible wire coil 192 is used instead of the tape 182. This wire coil can be made of the material, for example, of the "Slinky" toy device. This makes the signal member (wire) easy to replace in the housing.

Figure 16:
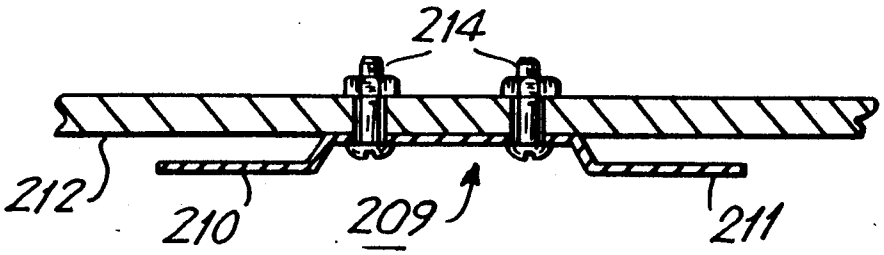
FIG. 16 is a cross-sectional view of a mounting bracket for the smoke detector shown in FIG. 17.
Figure 17:
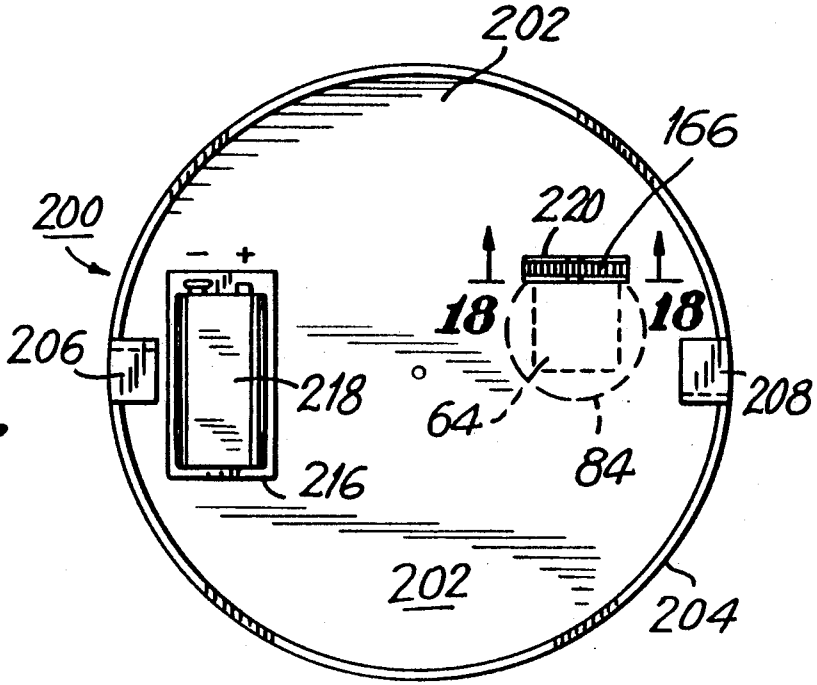
FIG. 17 is a top plan view of a smoke detector to be mounted with the bracket of FIG. 16 and incorporating the invention.
Figure 18:
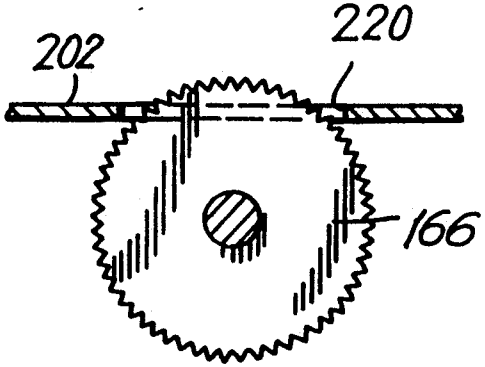
FIG. 18 is a cross-sectional view taken along line 18—18 of FIG. 17.

FIGS. 16, 17 and 18 show how the invention can be used in another popular type of smoke detector. This type of detector, which will be referred to herein as the "easily removable" type, utilizes a mounting bracket 209 as shown in the cross-sectional view of FIG. 16. The bracket 209 is mounted to the ceiling 212 of the room by means of screws or "mollys" 214. The bracket has a pair of depending L-shaped arms 210 and 212.

FIG. 17 is a top plan view of the smoke detector unit 200 itself. It has a pair of recesses 206 and 208 which mate with the ends of the brackets 210 and 211 so that when the unit 200 is pushed upwardly against the bracket 209, with the ends of the arms located counter-clockwise of the recesses 206 and 208, and then is rotated in a counter-clockwise direction (as shown in FIG. 17), the ends of the brackets 210 and 211 fit into the recesses to hold the smoke detector in place.

As it is well known, the unit 200 easily can be removed from the ceiling to give access to the battery compartment 216 to replace the battery 218. The battery compartment 216 is formed in the upper wall 202 of the smoke detector housing.

In accordance with the present invention, the smoke detector housing is provided with an opening 84 through which the indicator tape can drop from storage compartment 64 into the room below. A slot 220 is provided in the upper housing wall 202, and the thumb wheel 166 of the embodiment of the invention shown in FIG. 11 protrudes through the slot 22, as shown in FIG. 18.

In use, after the tape falls out of the smoke detector housing into the room, the user of the device reaches up and turns the housing of the smoke detector slightly to disengage it from the bracket 209 and lifts it down. The user removes the old battery 218 in the usual way, and replaces it with a fresh battery. Then, the user simply rolls up the tape into the housing 64 by the use of the exposed thumb wheel 220 edge. The occupant also easily can reach into the hole 84 to close the door 78 on the compartment 64 to prepare the unit for another use. Then the user replaces the smoke detector 200 on the mounting bracket 209.

It can be seen from the foregoing that the invention meets the objectives set forth above. The invention provides a low battery warning indicator which is very prominent and virtually impossible to ignore.

Furthermore, the indicator is compact and easily housed in a battery-operated smoke detector, and needs no operating power other than that provided by the weak battery.

The invention also provides a battery condition warning indication which is "permanent" in that it persists even after the battery has gone completely dead. This provides a vital reminder that the smoke detector is totally inoperative, especially when the invention is used with another audible or visible low battery warning device such as a flashing LED or beeping born.

The invention also is relatively fail-safe in operation, since gravity is used to deploy the signal strip.

The invention also encourages the user to replace the battery of the smoke detector by making it difficult to re-store the signal strip without first replacing the battery.

The invention also is relatively simple and inexpensive to manufacture, and easy to install and use.

Various changes may be made in the apparatus and method of this invention without departing from the spirit and scope of the same as defined in the appended claims.

What is claimed is:

1. A room-mountable battery-operated detector device, said device comprising, in combination, a housing, smoke detector means mounted in said housing, low battery condition indicator means mounted in said housing, said indicator means including a signal member normally stored in said housing and issuing means responsive to the detection of a low battery condition for issuing said signal member out of said housing and into the room in which the device is mounted, in which said signal member is an elongated flexible indicator member, and in which said issuing means is adapted to cause said indicator member to enter the room and hung down below said housing by a substantial distance to bring said indicator member into position to be readily seen by persons in the room.

2. A device as in claim 1 including means for mounting a battery in said housing, said cover being removable from said base member to replace said battery and said signal member therein.

3. A room-mountable battery-operated detector device, said device comprising, in combination, a housing, smoke detector means mounted in said housing, low battery condition indicator means mounted in said housing, said indicator means including a signal member normally stored in said housing and issuing means responsive to the detection of a low battery condition for issuing said signal member out of said housing and into the room in which the device is mounted, in which said signal member is an elongated flexible indicator member, and in which said issuing means is adapted to cause said indicator member to enter the room by a substantial distance to bring it in into position to be readily seen by persons in the room, and in which said issuing means includes means for releasing said indicator member from said housing and using the force of gravity to pull said member from said housing.

4. A device as in claim 3 including additional low battery signaling means in said housing, said additional signaling means being selected from the group consisting of a pulsating audible alarm and a flashing light source, and means for enabling said additional signaling means to operate when said signal member is issued.

5. A device as in claim 3 in which said housing has means for easily removing it from and replacing it on a wall of a room without tools, and a battery compartment accessible from outside said housing when removed from said wall and means extending outside said housing for retracting said signal member into said housing.

6. A device as in claim 3 in which said issuing means includes detecting means for detecting when the voltage of the battery in said device falls below a predetermined level and producing a corresponding signal, said housing having an outlet opening, and extending means for extending said signal member out of said housing through said outlet opening.

7. A device as in claim 6 in which said extending means comprises an electrically-operated release mechanism which allows said signal member to fall through said opening, and charge storage means for storing electrical energy from said battery and delivering the stored energy to said release mechanism in response to the signal from said detecting means.

8. A device as in claim 3 in which said housing has a base member with a cover, said cover having an outlet opening in it, and means for mounting said signal member in said housing near said opening, said issuing means being adapted to issue said signal member through said opening.

9. A device as in claim 8 in which said signal member is attached at one end inside said housing, holding means for gathering said tape-like member together and holding it in compacted form in said housing at a location above said opening in said cover, and releasing means for releasing said signal member to fall downwardly through said opening and hang from said housing.

10. A device as in claim 9 in which said holding means comprises a compartment with a lid, solenoid means for normally engaging said lid to close said compartment, said releasing means comprising means for operating said solenoid to disengage from and release said lid.

11. A device as in claim 9 in which said releasing means remains released and inhibits replacement of said signal member in said housing until the battery has been replaced with a fresh battery.

12. A room-mountable battery-operated detector device, said device comprising, in combination, a housing, smoke detector means mounted in said housing, low battery condition indicator means mounted in said housing, said indicator means including a signal member normally stored in said housing and issuing means responsive to the detection of a low battery condition for issuing said signal member out of said housing and into the room in which the device is mounted, in which said signal member is a light-weight prehensile member extending downwardly from said housing, when it is mounted on the ceiling of said room, to at least around eye level for adults standing in said room.

13. A room-mountable battery-operated detector device, said device comprising, in combination, a housing, smoke detector means mounted in said housing, low battery condition indicator means mounted in said housing, said indicator means including a signal member normally stored in said housing and issuing means responsive to the detection of a low battery condition for issuing said signal member out of said housing and into the room in which the device is mounted, in which said signal member is made of material selected from the group consisting of a tape or string; an accordion-foldable, pre-creased resilient tape; and a flexible wire coil.

14. A room-mountable battery-operated detector device, said device comprising, in combination, a housing, smoke detector means mounted in said housing, low battery condition indicator means mounted in said housing, said indicator means including a signal member normally stored in said housing and issuing means responsive to the detection of a low battery condition for issuing said signal member out of said housing and into the room in which the device is mounted, including a reel rotatably mounted in said housing for storing said indicator member in wound form, for unwinding to issue said indicator member from said housing to form a low-battery signal, and for re-winding to re-store said indicator member in said housing.

15. A device as in claim 14 including a thumb-wheel drivably coupled to said reel for use in manually rewinding said indicator member.

16. A device as in claim 14 in which said housing has a battery compartment accessible from outside said housing, and rewind means accessible from outside said housing to rewind said indicator member on said reel.

17. A device as in claim 16, in which said rewind means comprises a thumb-wheel one edge of which extends through a slot in a wall of said housing.

18. A method for operating a battery-powered smoke detector device, said method comprising the steps of, operatively associating highly prominent low device battery condition warning indicator means with said device, and operating said warning indicator means in response to a low condition of the device battery to extend from the device and provide highly prominent indication of said low device battery condition, said operating step comprising extending said low battery condition warning indicator means from said device under the force of gravity, said warning indicator means comprising an elongated, flexible signal member, and causing said member to hang down in a room to a level adjacent where people walk, to remind the people to replace the battery in the smoke detector.

19. A replacement cartridge for a low battery indicator in a smoke detector, said indicator comprising an elongated flexible member normally compacted into a small size, but being extended during actuation, said cartridge comprising a holder mountable in said smoke detector and holding said elongated flexible indicator member in compacted form.

20. A cartridge as in claim 19 including mounting means for a battery, said battery mounting means being secured to said holder.

21. A cartridge as in claim 20 in which said holder is selected from the group consisting of a reel and a closable housing.

22. A method for operating a battery-powered smoke detector device, said method comprising the steps of, operatively associating highly prominent low device battery condition warning indicator means with said device, and operating said warning indicator means in response to a low condition of the device battery to extend from the device and provide highly prominent indication of said low device battery condition, said indicator means comprising an elongated, prehensile element, said operatively associating step comprising storing said element in compacted form within the housing of said device, said operating step comprising extending said element by a substantial distance outside of said housing and causing it to fall by gravity into a room which said device is located to a level well below said device in said room.

23. A method as in claim 22, including the step of actuating an auxiliary alarm together with said indicator means, said alarm being selected from an intermittent sound source and a flashing light, and continuing the extension of said indicator means from said device after the battery of said smoke detector has gone dead and said auxiliary alarm is disabled due to loss of battery power.

* * * * *